US006488335B1

(12) United States Patent
Cioncada

(10) Patent No.: US 6,488,335 B1
(45) Date of Patent: Dec. 3, 2002

(54) CHAIR WITH VARIABLE PITCH

(76) Inventor: Enrico Cioncada, Viale del Bosco, 1-84100 Salerno (IT)

( * ) Notice: Subject to any disclaimer, the term of this patent is extended or adjusted under 35 U.S.C. 154(b) by 0 days.

(21) Appl. No.: 09/787,542

(22) PCT Filed: Sep. 22, 1999

(86) PCT No.: PCT/EP99/07044

§ 371 (c)(1),
(2), (4) Date: Mar. 20, 2001

(87) PCT Pub. No.: WO00/18274

PCT Pub. Date: Apr. 6, 2000

(30) Foreign Application Priority Data

Sep. 25, 1998 (IT) ..... VI98A0182

(51) Int. Cl.[7] ..... A47C 1/024; A47C 1/038; A47C 3/025; B60N 2/12

(52) U.S. Cl. ..... 297/300.2; 297/300.1; 297/316; 297/320; 297/341; 297/342; 297/354.11

(58) Field of Search ..... 297/300.2, 320, 297/316, 300.1, 341, 342, 354.11

(56) References Cited

U.S. PATENT DOCUMENTS

| | | | | | |
|---|---|---|---|---|---|
| 293,813 | A | * | 2/1884 | St. John | 297/320 X |
| 711,412 | A | * | 10/1902 | Archambeault | 297/342 X |
| 1,026,074 | A | * | 5/1912 | Cain | 297/300.2 |
| 1,928,857 | A | * | 10/1933 | Kelly | 297/300.1 X |
| 2,171,189 | A | * | 8/1939 | Platter et al. | 297/342 X |
| 2,560,796 | A | * | 7/1951 | Hollis | 297/342 X |
| 2,674,303 | A | * | 4/1954 | Dorton | 297/342 |
| 3,337,266 | A | * | 8/1967 | Burns | 297/320 X |
| 3,427,072 | A | * | 2/1969 | Hale | 297/316 X |
| 3,536,358 | A | * | 10/1970 | Masucci | 297/342 |
| 3,724,896 | A | * | 4/1973 | Belk | 297/342 X |
| 4,078,841 | A | * | 3/1978 | Kiang | 297/342 X |
| 4,084,850 | A | * | 4/1978 | Ambasz | 297/342 X |
| 4,157,203 | A | * | 6/1979 | Ambasz | 297/354.11 X |
| 4,452,486 | A | * | 6/1984 | Zapf et al. | 297/341 X |
| 4,595,236 | A | * | 6/1986 | Rizzoli | 297/300.1 X |
| 4,840,426 | A | * | 6/1989 | Vogtherr et al. | 297/342 X |
| 5,108,149 | A | * | 4/1992 | Ambasz | 297/342 |
| 5,154,472 | A | * | 10/1992 | Kaufman | 297/316 X |
| 5,366,274 | A | * | 11/1994 | Roericht | 297/300.2 X |
| 5,782,536 | A | * | 7/1998 | Heidmann et al. | 297/300.2 X |
| 5,871,258 | A | * | 2/1999 | Battey et al. | 297/300.2 X |

FOREIGN PATENT DOCUMENTS

| | | | | |
|---|---|---|---|---|
| DE | 26 44 412 | | 4/1978 | |
| DE | 295 20 899 | | 8/1996 | |
| EP | 0 377 138 | | 7/1990 | |
| WO | WO 91/03191 | * | 3/1991 | 297/300.1 |

* cited by examiner

*Primary Examiner*—Rodney B. White
(74) *Attorney, Agent, or Firm*—Dykema Gossett, PLLC

(57) ABSTRACT

A chair with variable pitch having a frame set to rest on the floor, at least one central element that creates a substantially horizontal longitudinal axis supported by the frame, a seat supported by the central element, one pair of first stiles parallel to each other and set at the ends of the central element, and a backrest that has its top connected to the first stiles through first flexible couplings and its bottom connected to the seat through a second flexible coupling. The seat is connected to the central element through swivel means that allow the planar rotary-transverse movement of the seat, combined with a rotary rocking movement of the backrest around a longitudinal axis created by the flexible couplings.

17 Claims, 11 Drawing Sheets

CHAIR WITH VARIABLE PITCH

BACKGROUND OF THE INVENTION

The invention concerns a chair designed to take on variable pitches or attitudes under the push exerted on the seat and on the backrest by the seated person.

The market offers several types of chairs that have a variable pitch obtained by exploiting the flexing deformability of the structure making up the seat or backrest, or otherwise in some cases, fitting flexible parts between the structural components of the chair itself.

The pressure that the seated person exerts on the seat or on the backrest, or on both together, modifies the pitch of the chair permitting change of the seating position as desired.

It is common knowledge that by frequently changing from a leaning forward position to stretching backwards, the user tends to rub against the surface of the seat with inevitable inconveniences and discomfort.

What's more, the most natural positions that the user tends to assume are often limited by the sole intrinsic flexing deformability of the components that make up the chair without any possibility of adjustment.

With the scope of eliminating these inconveniences, the same applicant filed an Italian patent application published with reference number V197AOOO183 and granted as IT01296682, which describes a chair with variable pitch that allows the seated person to change from a leaning forward position to more or less stretching backwards by simply pushing on the seat or on the backrest or both together, without having to rub on the surface of the seat.

What's more, the range in variation of pitch can be modified by regulating special adjustments.

However, even the chair with variable pitch described in the aforementioned patent has the inconvenience of only permitting the seat to perform forward or backward linear movements.

The present invention intends to overcome the aforementioned limitation.

BRIEF SUMMARY OF THE INVENTION

The scope of this invention is to produce a chair with variable pitch that allows greater degrees of freedom in the seat's movement.

Such scope is achieved by producing a chair with variable pitch that has a frame set to rest on the floor; at least one central element that creates a substantially horizontal longitudinal axis X, supported by the frame; a seat supported by the central element; one pair of first stiles parallel to each other and set at the ends of the central element; and a backrest that has its top connected to each of the first stiles through first flexible couplings and its bottom connected to the seat through at least one second flexible coupling, it is characterised in that the seat is connected to the central element through swivel means designed to allow a planar rotary transverse movement of the seat combined with a rotary rocking movement of the backrest around a longitudinal axis created by the first flexible couplings.

According to a preferred form of execution the frame is made up of one pair of front legs connected to the ends of the central element as a continuation of the first stiles, and at least one pair of back legs parallel to each other and also each being connected to one of the ends of the same central element.

According to a variant in execution the frame has a single, substantially upright supporting body that has its top connected to the central element and its bottom provided with a floor standing structure.

According to both of the forms of execution, each of the swivel means that allow a rotary-transverse movement of the seat include a first swivel element fixed to the seat and a second swivel element that slides over the central element along the latter's longitudinal axis. The swivel elements are connected together through flexible couplings and have contact surfaces that touch together.

By a combination of the reciprocal sliding movement of the contact surfaces over each other in combination with the longitudinal movement of the swivel elements around the central element, a planar rotary-transverse movement of the seat is generated parallel to the level on which the seat rests when in its idle position.

BRIEF DESCRIPTION OF THE SEVERAL VIEWS OF THE DRAWINGS

The aforesaid scopes shall be better illustrated in the description of a preferred form of execution of the chair invention that is described below and that refers to the attached diagrams, where.

DETAILED DESCRIPTION OF THE INVENTION

Figure 1:
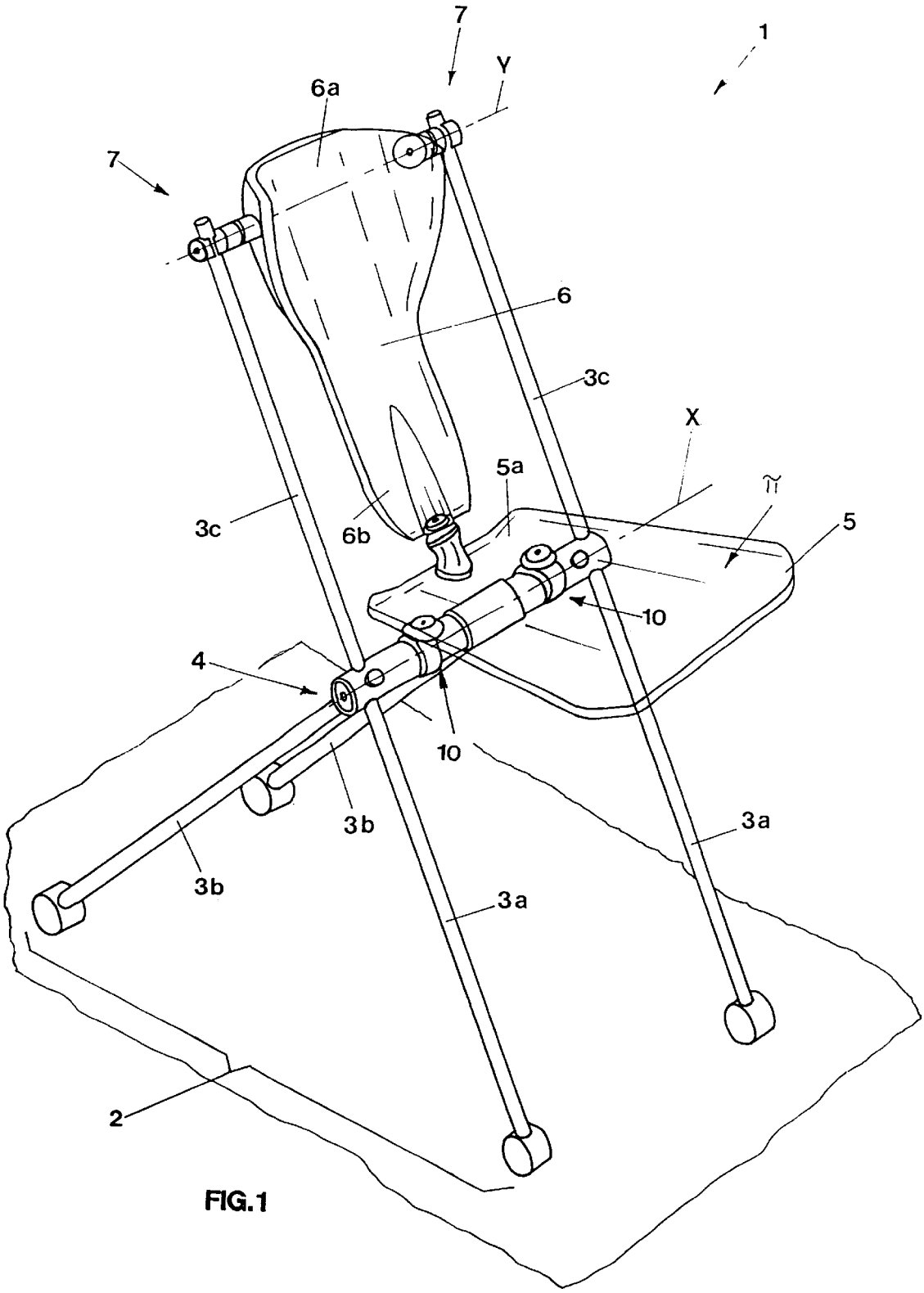
FIG. 1 shows an isometric drawing of the chair invention.
Figure 2:
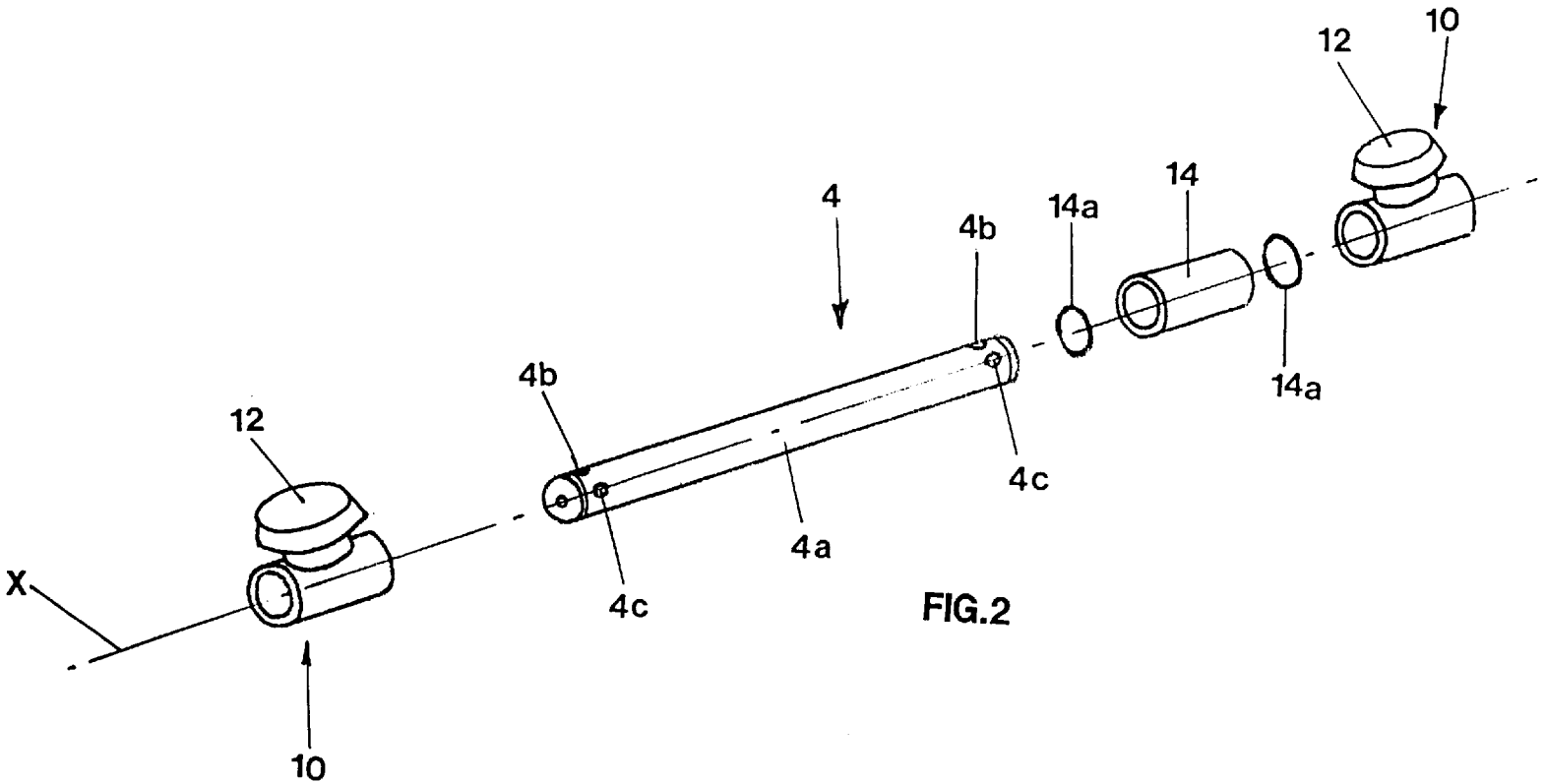
FIG. 2 illustrates a blown-up isometric view of the central element of the chair in FIG. 1.
Figure 3:
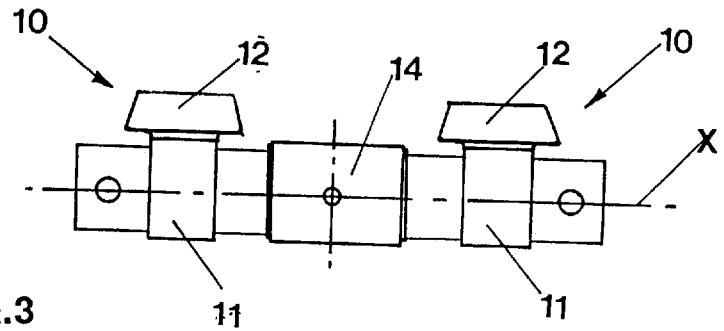
FIG. 3 illustrates the front view of the assembled central element in FIG. 2.
Figure 4:
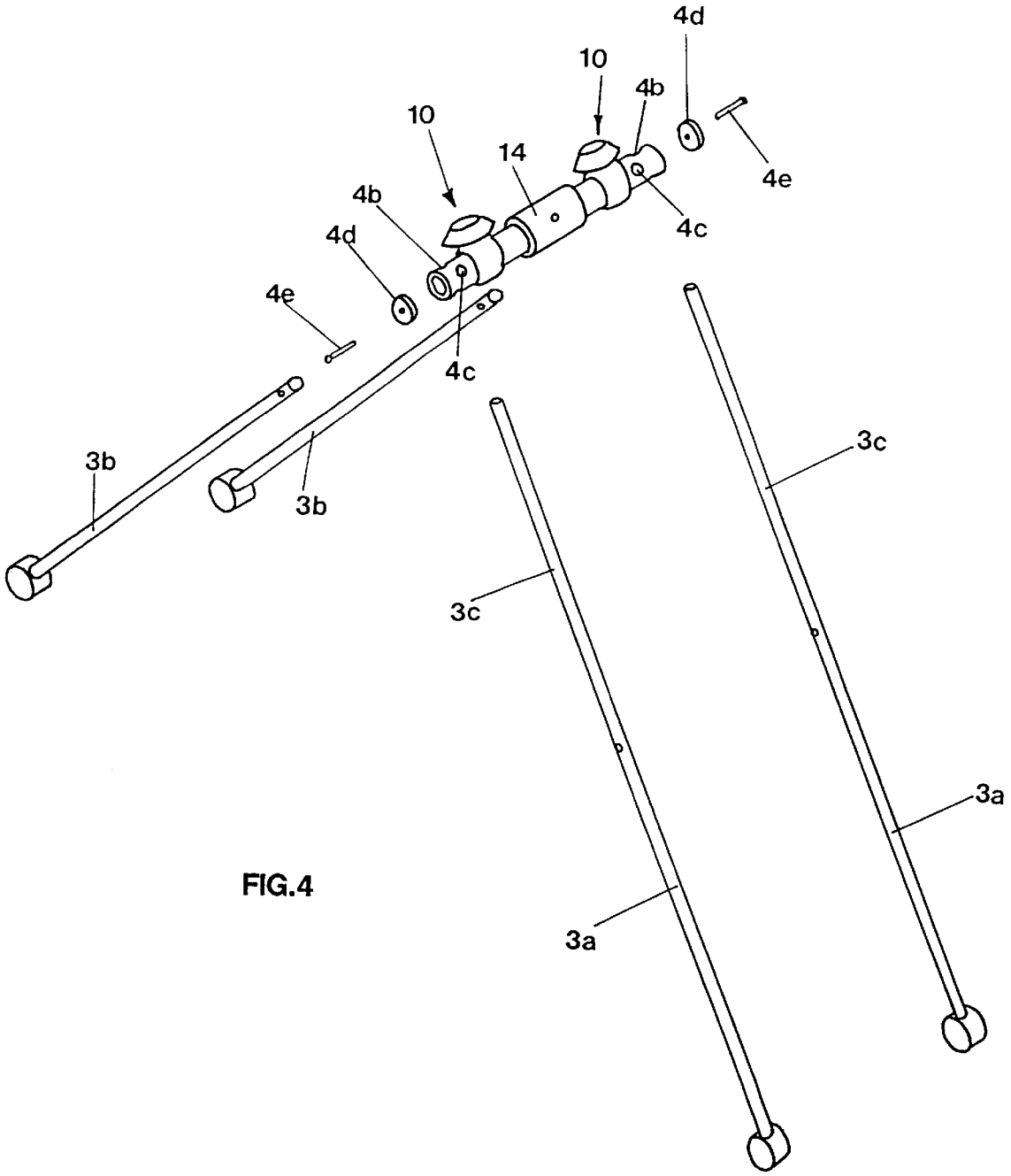
FIG. 4 illustrates a blown-up isometric view of the chair in FIG. 1 without its backrest and seat.
Figure 5:
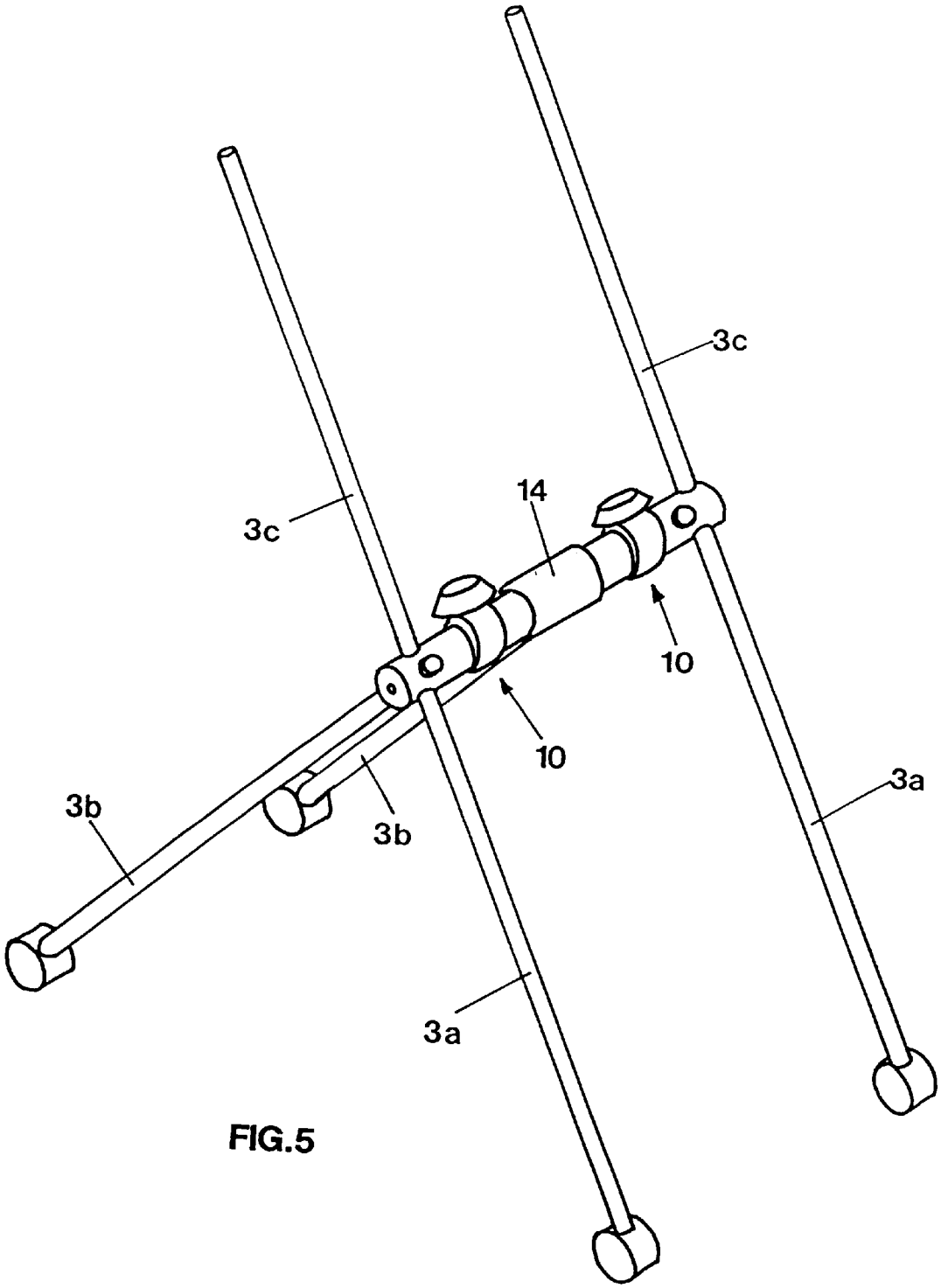
FIG. 5 illustrates the elements shown in FIG. 4 assembled together.

As can be seen in FIG. 1 the chair invention, generally indicated by 1, includes a frame, generally indicated by 2, consisting of one pair of front legs 3*a* and one pair of back legs 3*b*, which rest on the floor and their ends are connected to a central element, generally indicated by 4 and creating a substantially horizontal longitudinal axis X, which supports the seat 5.

As a continuation of the front legs 3*a* there are as many first stiles 3*c* as there are front legs 3*a*. The front stiles 3*c* are connected to the ends of the central shaft 4, preferably but not necessarily as one with the front legs 3*a* thereby making a single, linear body.

A backrest 6 has its top 6*a* connected to the first stiles 3*c* through one pair of first flexible couplings each generally indicated by 7. The first flexible couplings 7 create a longitudinal axis Y around which the backrest rotates. A second flexible coupling, generally indicated by 8, connects the bottom 6*b* of the backrest 6 to the back 5*a* of the seat 5. In this way, the seat 5 and the backrest 6 are solidly and flexibly connected together.

As a preference, to make the seat more comfortable, the longitudinal axis Y of the first flexible couplings 7 is parallel to the longitudinal axis X of the central element 4.

Figure 7:
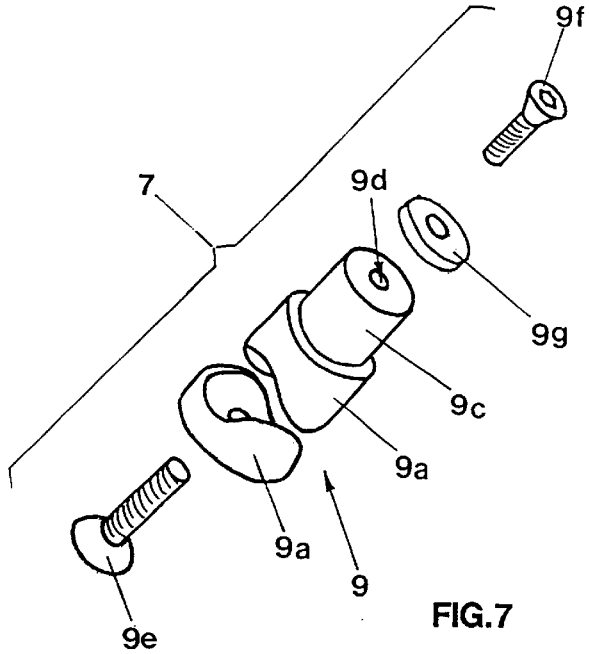
FIG. 7 illustrates a blown-up view of the first flexible coupling that connects the backrest to its respective first stile.
Figure 6:
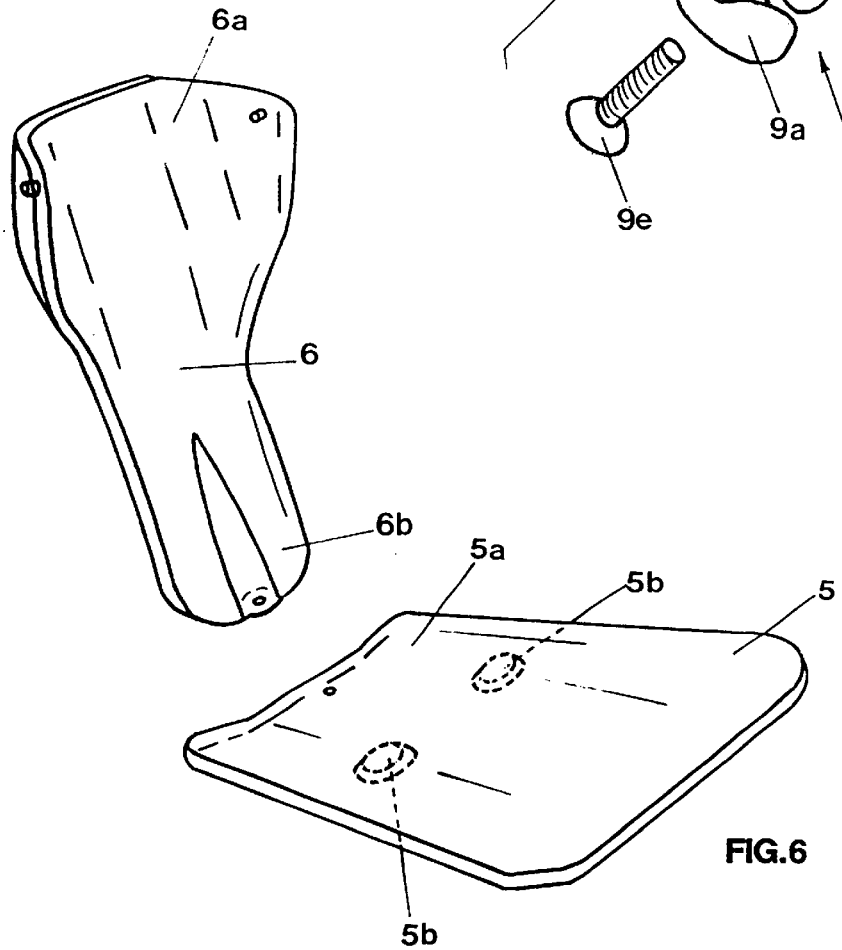
FIG. 6 illustrates a blown-up isometric view of the backrest and seat of the chair in FIG. 1.
Figure 9:
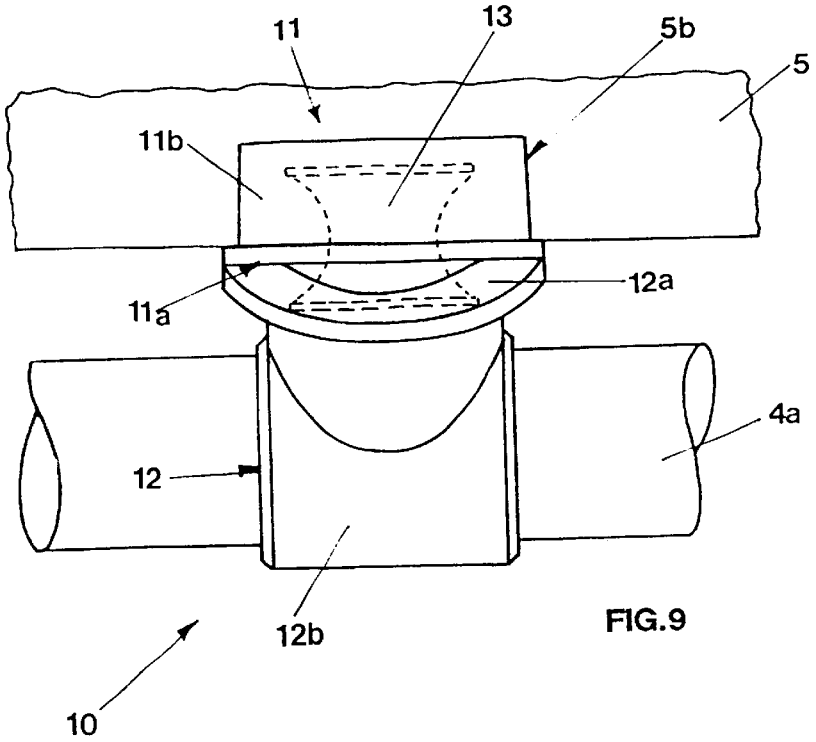
FIG. 9 illustrates a view of one of the chair's swivel elements shown in its idle position.
Figure 10:
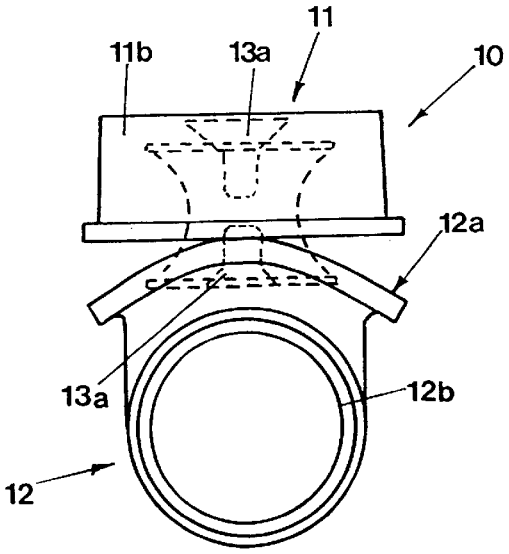
FIG. 10 illustrates another view of the swivel element in FIG. 9.
Figure 11:
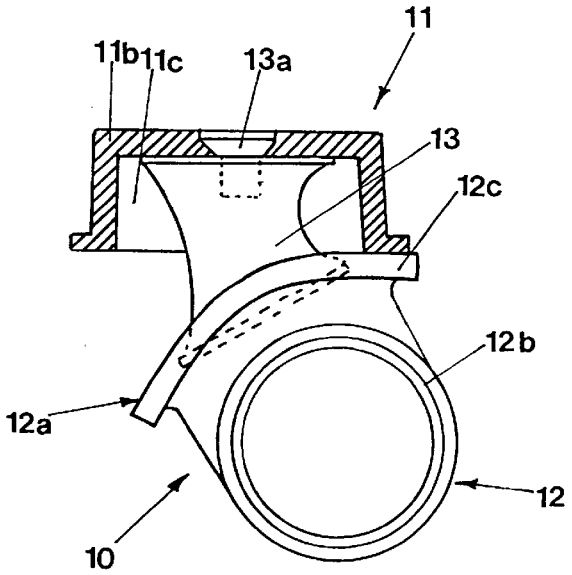
FIG. 11 illustrates the swivel element in FIG. 10 partially sectioned and when in use.
Figure 14:
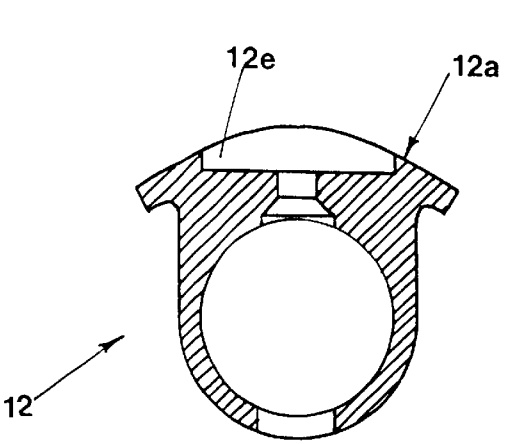
FIG. 14 illustrates a cross-section of the detail in FIG. 13.
Figure 13:
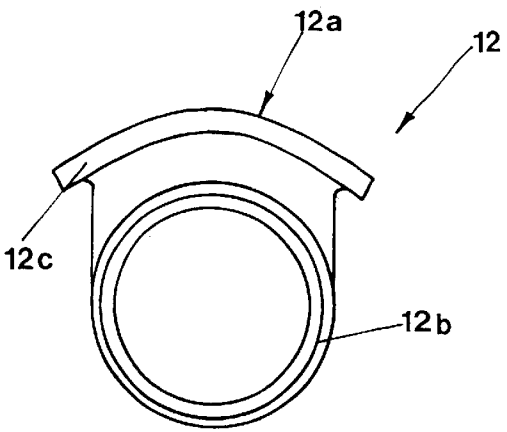
FIG. 13 illustrates another view of the detail in FIG. 12.
Figure 12:
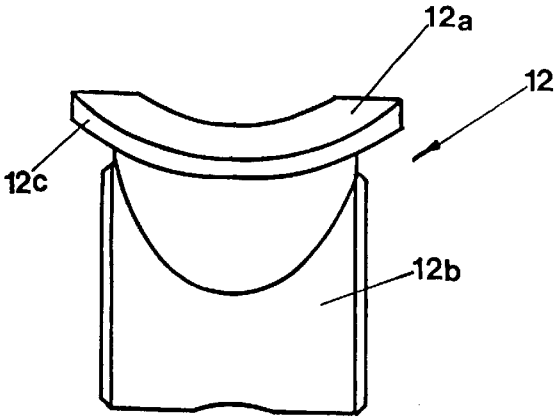
FIG. 12 illustrates a view of one of the details that make up the swivel element in FIG. 9.
Figure 16:
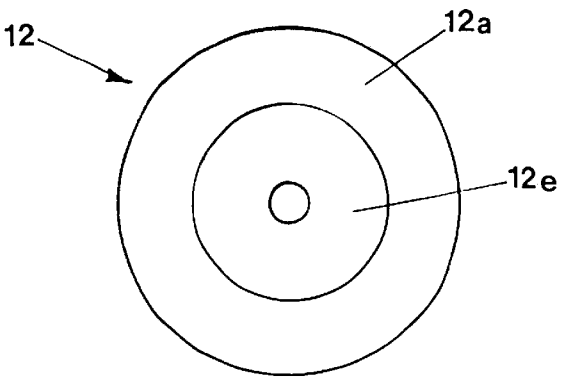
FIG. 16 illustrates an aerial view of the detail in FIG. 12.
Figure 15:
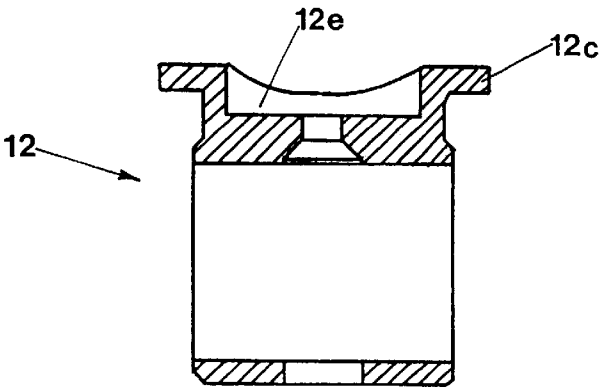
FIG. 15 illustrates a longitudinal section of the detail in FIG. 12.

With regards to each first flexible coupling 7 that can be seen in detail in FIG. 7, it includes a clamp 9 made up of two halfrings 9*a* that together create a seating 9*b* designed to receive its respective first stile 3*c* and a pliable body 9*c* coupled to one of the halfrings 9*a*. A threaded hole 9*d* made in the pliable body 9*c*, receives first union means consisting of one pair of screws 9*e* and 9*f*, designed to connect the elements together and to the backrest 6. Preferably, as can be seen, a washer 9*g* is inserted.

Figure 8:
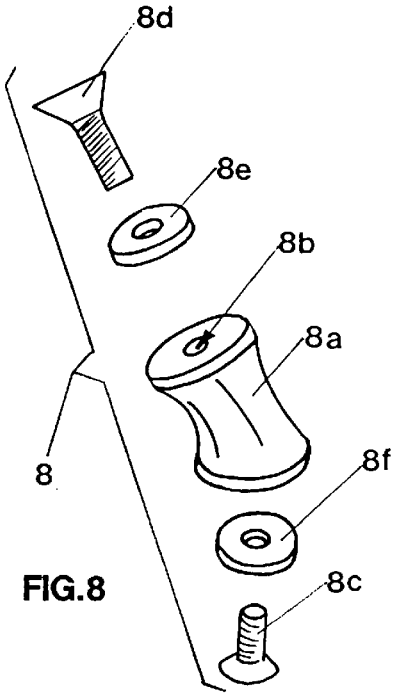
FIG. 8 illustrates a blown-up isometric view of the second flexible coupling that connects the seat to the backrest.

With regards to the second flexible coupling 8 that can be seen with more detail in FIG. 8, it includes a substantially cylindrical element 8*a*, which can be flexed out of shape, that has a threaded hole 8*b* through its whole length. It is designed to receive second union means consisting of screws 8*c* and 8*d* that allow it to be fixed between the back 5*a* of the seat 5 and the bottom 6*a* of the backrest 6. The assembly preferably includes washers 8*e* and 8*f*.

It is clear that in different forms of execution the first union means and the second union means, instead of being screws and internal threads, they may be other forms of union. What's more, these union means may also have washers.

Finally, with regards to the central element generally indicated by 4 and seen with more detail in FIGS. 2 to 5, it is preferably but not necessarily consists of a tubular element 4*a* with a circular section that has holes 4*b* and 4*c* at its ends designed to receive the respective couplings of the first stiles 3*c* with their relative front legs 3*a* and back legs 3*b*. The ends of the tubular element 4*a* are closed by plugs 4*d* fastened by screws 4*e*.

According to the invention, the seat 5 is connected to the central element 4 through swivel means 10 designed to allow a planar rotary-transverse movement of the seat 5 combined with a rotary rocking movement of the backrest 6 around the longitudinal axis Y created by both of the first flexible couplings 7.

The swivel means, as can be seen, count two and each of them, as can be seen in FIGS. 9 to 16, include a first swivel element 11 that is solidly fixed to the seat 6 and a second swivel element 12 that slides over the central element 4. They are connected together through flexible means consisting of a pliable body 13 attached to both through fixing means preferably being screws 13*a*.

The swivel elements 11 and 12 also have contact surfaces that touch, 11*a* ind 12*a* respectively, designed to work together during the reciprocal movement of the swivel elements to keep the movement of the seat 5 complanar with its original level.

In particular the first swivel element 11 includes a cylindrical body 11*b* that is fitted into its seating 5*b* of the seat 5 and has a first blind housing 11*c* that receives one end of the pliable body 13. On the outer rim 11*d* of the cylindrical body 11*b* defines the aforementioned contact surface 11*a*.

The second swivel element 12 is made of a tubular element 12*b* that has a sliding coupling on the outside of the tubular body 4*a* of central element 4 and has an curved outer rim 12*c* that defines the aforementioned contact surface 12*a*. In addition, a second blind housing 12*e* receives the other end of the pliable body. Between the swivel means 10 there is a spacer sleeve 14 on he outside of the central element 4 and set at its centre, which acts as a travel stop when the swivel means 10 are turning around the longitudinal axis X of the actual central body. The existence of elastic seals 14*a* between the spacer and central element prevent foreign bodies from entering between the coupled surfaces.

It works when the seated person pushes against the seat 5 or against the backrest 6 or against both, the force discharged onto the swivel means 10 generates an axial component along the longitudinal axis X of the central element 4 that tends to shift the seat 5 in that direction and a tangential component that vice-versa tends to make it turn around the central element 4.

Figure 17:
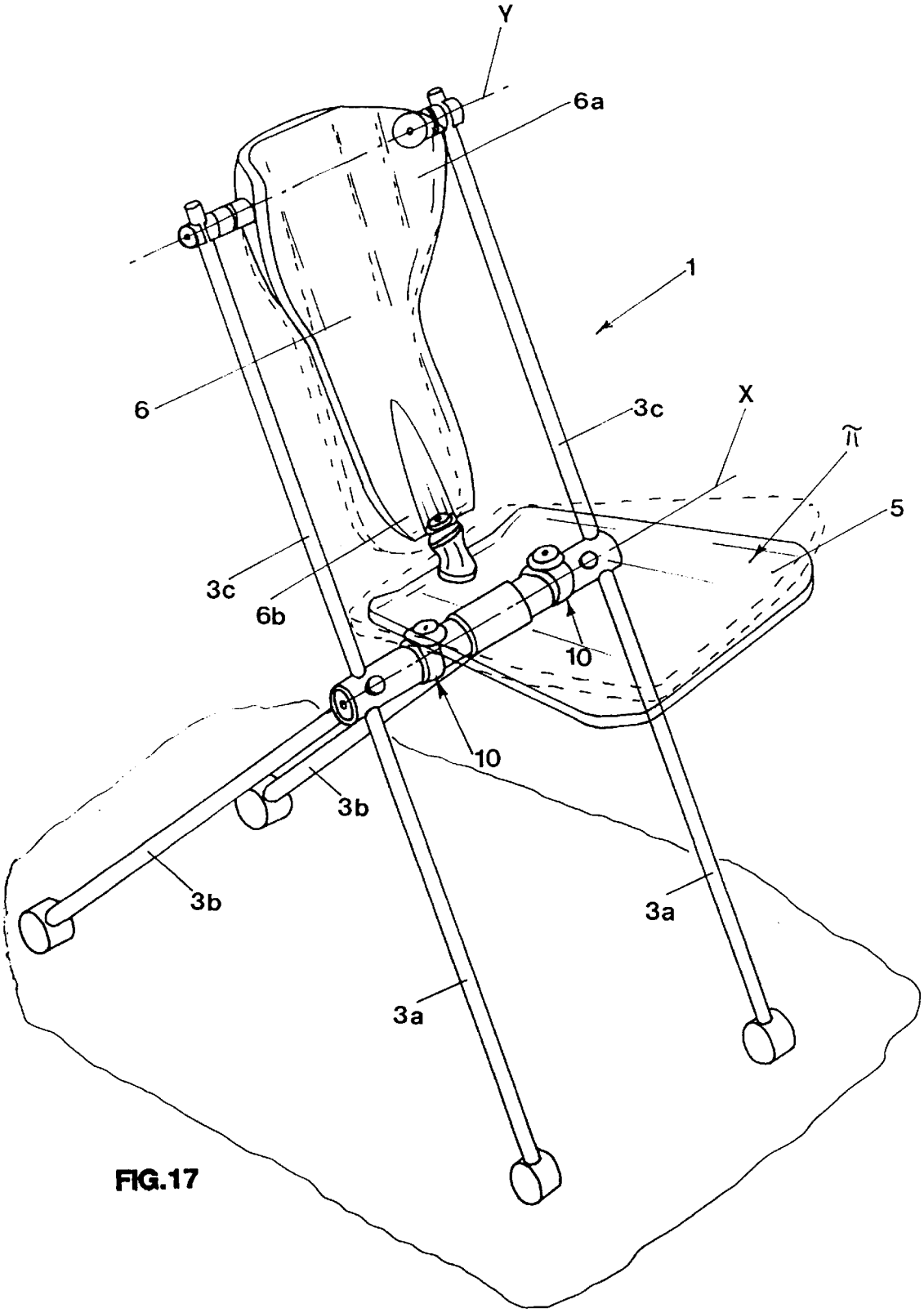
FIG. 17 illustrates the chair in FIG. 1 where a dotted line shows one of the possible positions the seat and backrest may assume while varying pitch.
Figure 18:
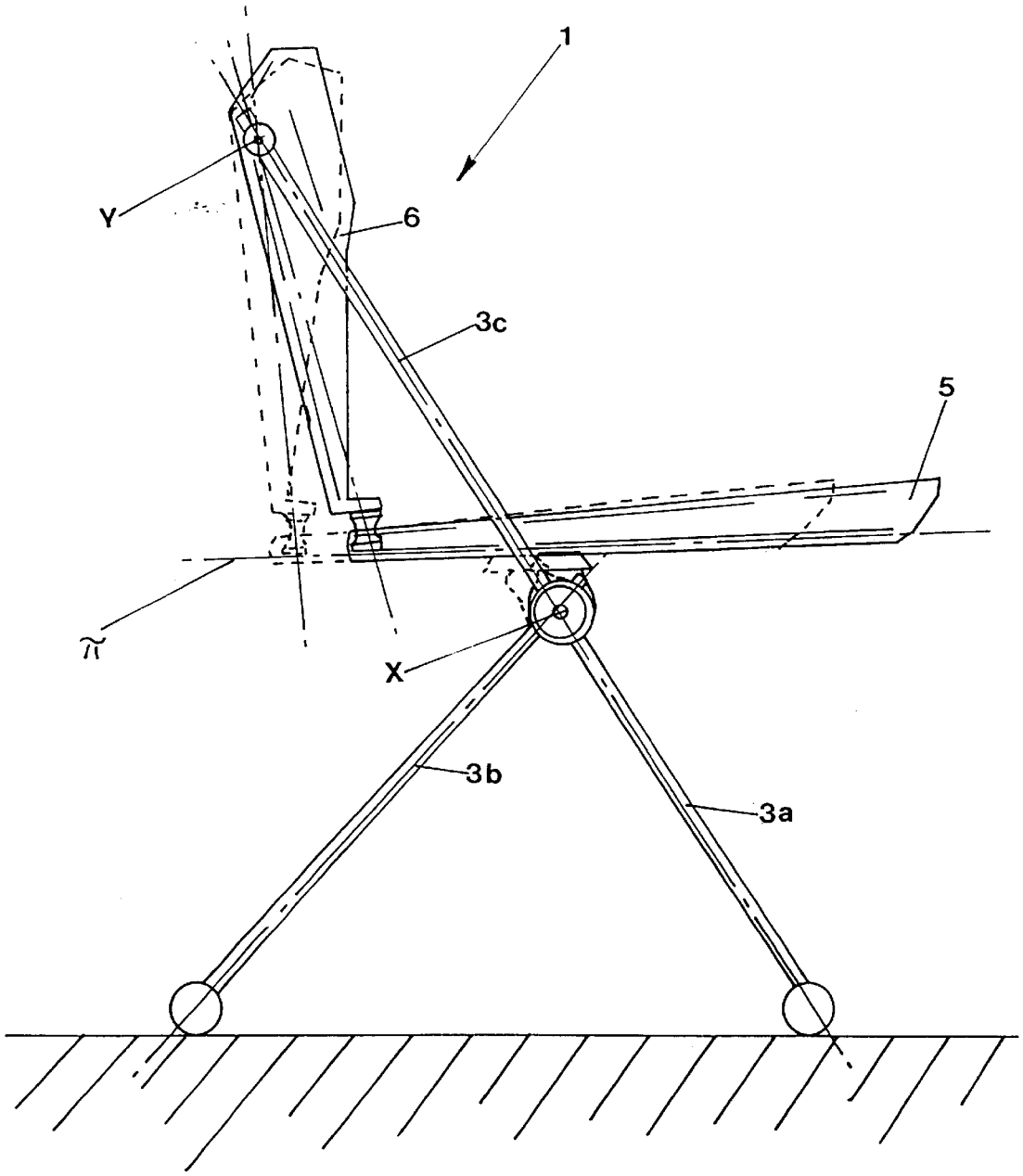
FIG. 18 illustrates a side view of the chair in FIG. 17.
Figure 19:
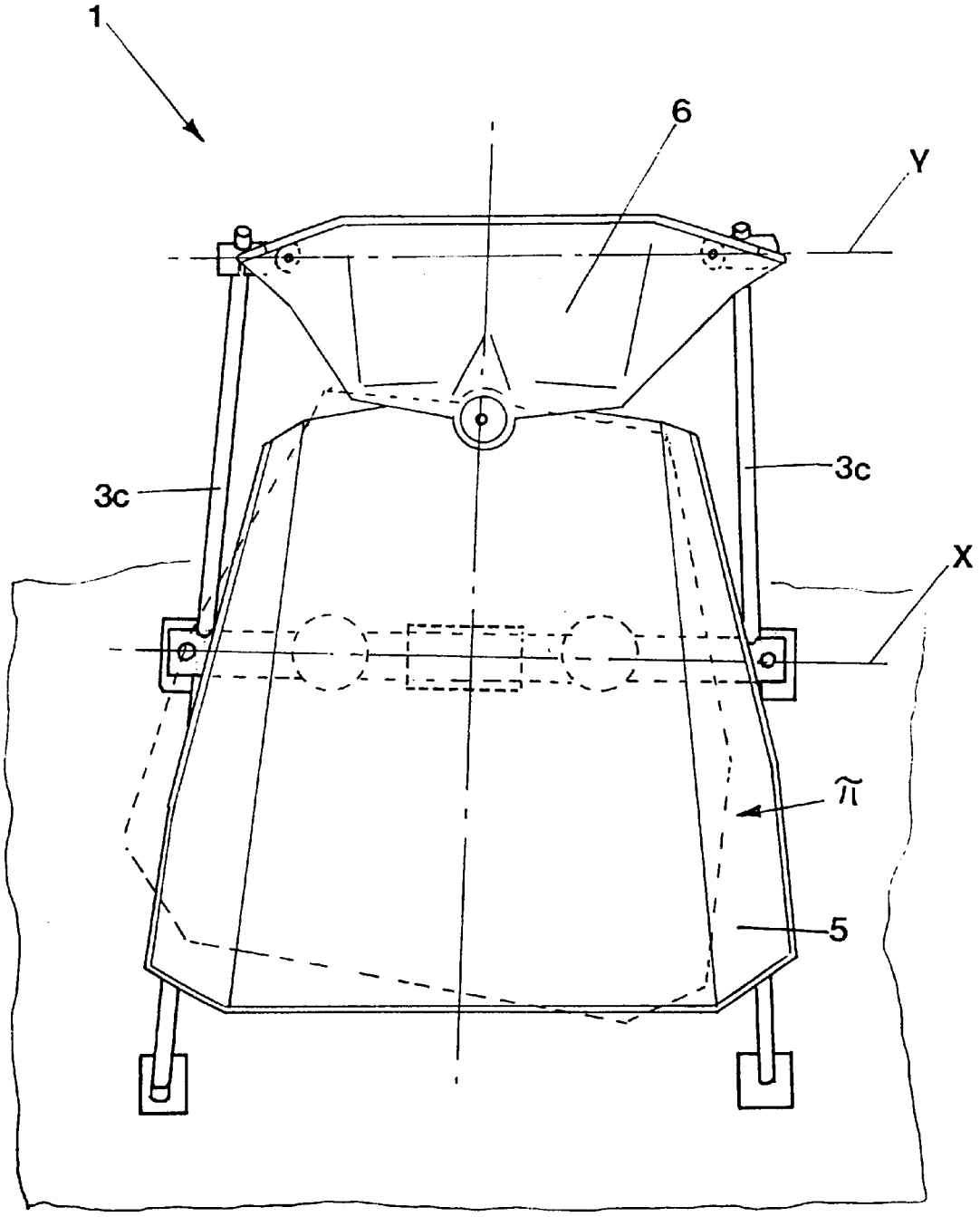
FIG. 19 illustrates an aerial view of the chair in FIG. 17.

A combination of the two movements thereby obtains a planar rotary-transverse movement that, as seen in FIGS. 17 to 19, is developed keeping the seat 5 constantly parallel to plane $T_{TT}$ as it is found when in its idle position.

At the same time as this planar rotary-transverse movement of the seat 5, a rocking movement of the backrest 6 is also obtained around the longitudinal axis Y created by the first flexible couplings 7, which varies its angle as shown in FIG. 18.

The seat 5 and the backrest 6, with reference to FIG. 17, are therefore set in the positions indicated by the dotted line, with respect to the initial idle position that the same diagram shows by plain lines.

In this way the seated person can easily change position of the backrest and the seat as desired, by shifting the latter forwards or backwards and at the same time even sideways, always keeping the seating plane quite parallel to its initial position.

Figure 20:
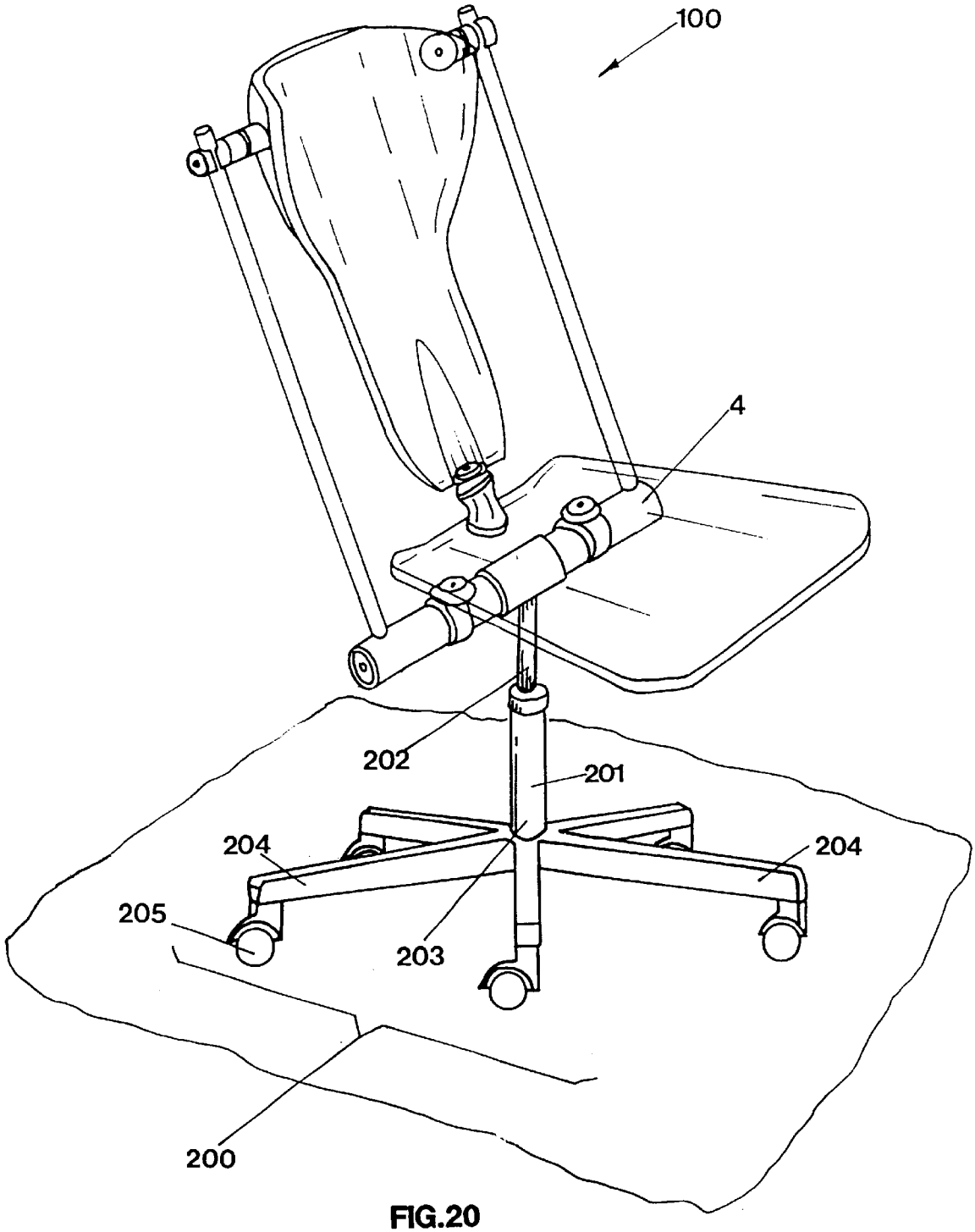
FIG. 20 illustrates a variant in execution of the chair invention.

A variant in execution of the chair invention is illustrated in FIG. 20, where it is generally indicated by 100.

This differs from the variant in execution just described in that the frame, generally indicated by 200, includes a single, substantially upright supporting body 201, which has its top 202 connected to the central element 4 of the chair and its bottom 203 provided with a floor standing components 204.

The floor standing components 204 are preferably provided with wheels 205 designed to make the chair mobile.

With regards to its top 202, this can be telescopic from within its supporting body 201 thereby also making the chair adjustable in height.

It is clear that the chair invention in both the executive variants that have been described and illustrated, may be constructed in any kind of form or size and may also have variations in execution concerning the flexible couplings and union means.

Even though the invention has been described with reference to the figures illustrated in the attached diagrams, it may be subject to many changes and variations in execution, all falling under the inventive concept expressed by the attached claims.

What is claimed is:

1. A chair with variable pitch comprising:

a frame set to rest on the floor;

at least one central element having opposite ends and defining a substantially horizontal longitudinal axis supported by said frame;

a seat supported by said central element;

one pair of first stiles parallel to each other and set at the ends of said central element;

a backrest that has a top connected to each of said first stiles through flexible couplings and a bottom connected to said seat through at least one second flexible coupling;

said seat is connected to said central element through swivel means designed to allow a planar rotary-transverse movement of said seat, combined with a rotary rocking movement of said backrest around a longitudinal axis created by said flexible couplings to the stiles.

2. A chair according to claim 1, wherein said frame comprises at least one pair of front legs connected to the ends of said central element and at least one pair of back legs connected to the ends of said central element.

3. A chair according to claim 2, wherein each front leg is set as a continuity of a corresponding first stile with which it creates a single, linear body.

4. A chair according to claim 2, wherein said central element comprises a tubular body with a circular section that has holes at its ends designed to receive said first stiles and said legs.

5. A chair according to claim 1, wherein said frame comprises a single supporting body having a substantially upright stature with a frame top connected to said central element and a frame bottom provided with floor standing components.

6. A chair according to claim 1, wherein the plane of said rotary-transverse movement made by said seat is substantially parallel to the plane on which said seat rests when in an idle position.

7. A chair according to claim 1, wherein said longitudinal axis (Y) created by said first flexible means is substantially parallel to the longitudinal axis (X) created by said central element.

8. A chair according to claim 1, wherein each of said swivel means comprises a first swivel element fixed to said seat and a second swivel element that slides over said central element along the longitudinal axis (X) of said central element, said swivel elements being connected together through flexible means.

9. A chair according to claim 8, wherein each of said swivel elements have contact surfaces that touch together.

10. A chair according to claim 8, wherein said first swivel element consists of a cylindrical body that is received in a seating made in said seat and has a first contact surface on its outer rim and a first blind housing designed to receive said flexible means.

11. A chair according to claim 8, wherein said second swivel element is made of a tubular element with its outside having a second contact surface made on the curved outer rim and on its outside it has a second blind housing designed to receive said flexible means.

12. A chair according to claim 8, wherein said flexible means comprises of at least one pliable body inserted between said swivel elements and fixed to both through fixing means.

13. A chair according to claim 12, wherein said flexible means are made in elastomer.

14. A chair according to claim 1, wherein each first flexible coupling has a clamp coupled to its respective first stile and a pliable body inserted between said clamp and said backrest, said clamp and said pliable body having a hole designed to receive first union means to tighten the clamp and lock said backrest to its respective first stile.

15. A chair according to claim 14, wherein said clamp comprises two halfrings that together create a seating that receives said first stile.

16. A chair according to claim 1, wherein said second flexible coupling includes a substantially cylindrical element which can be flexed out of shape, inserted between the bottom of said backrest and the back of said seat to which it is fixed through second union means.

17. A chair with variable pitch, comprising:

a frame;

at least one central element with two opposing ends, said central element connected to said frame and having a longitudinal axis;

a seat attached to said central element with a swivel means;

a pair of first stiles, one of said stiles attached at one end of said central element and the other of said stiles attached at the opposite end of said central element, each of said first stiles is parallel to the other of said first stiles;

a backrest having a top and a bottom, said top is attached to said pair of first stiles with at least one first flexible coupling, and said bottom is attached to said seat with at least one second flexible coupling;

said first and second flexible couplings having a longitudinal axis therethrough;

wherein said swivel means allows for a planar rotary-transverse movement of the seat, and said flexible couplings allow for a rotary rocking movement of said backrest around said longitudinal axis of said coupling means.

* * * * *